US011359418B2

(12) United States Patent
Rosales

(10) Patent No.: US 11,359,418 B2
(45) Date of Patent: Jun. 14, 2022

(54) MOTOR VEHICLE LOCK

(71) Applicant: Brose Schliesssysteme GmbH & Co. Kommanditgesellschaft, Wuppertal (DE)

(72) Inventor: David Rosales, Rochester Hills, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 756 days.

(21) Appl. No.: 16/039,854

(22) Filed: Jul. 19, 2018

(65) Prior Publication Data

US 2020/0024875 A1 Jan. 23, 2020

(51) Int. Cl.
*E05B 81/20* (2014.01)
*E05B 85/26* (2014.01)
(Continued)

(52) U.S. Cl.
CPC ..... *E05B 81/20* (2013.01); *E05B 81/06* (2013.01); *E05B 81/18* (2013.01); *E05B 81/21* (2013.01); *E05B 85/26* (2013.01)

(58) Field of Classification Search
CPC ..... E05B 81/06; E05B 81/18; E05B 81/20; E05B 81/21; E05B 81/24; E05B 81/25;
(Continued)

(56) References Cited

U.S. PATENT DOCUMENTS 4,927,196 A 5/1990 Girard et al.
6,422,615 B1 7/2002 Roos et al.
(Continued)

FOREIGN PATENT DOCUMENTS

DE 10049895 W 4/2002
DE 10123187 A1 * 11/2002 ..... E05B 81/22
(Continued)

OTHER PUBLICATIONS

"Final Office Action," for U.S. Appl. No. 16/039,851 dated Dec. 20, 2021 (17 pages).
(Continued)

*Primary Examiner* — Kristina R Fulton
*Assistant Examiner* — Noah Horowitz
(74) *Attorney, Agent, or Firm* — Pauly, DeVries Smith & Deffner LLC

(57) ABSTRACT

A motor vehicle lock has a pawl and a catch that may be moved into an open position, a preliminary latching position and a main latching position. In one latching position, that catch is or may be brought into holding engagement with a lock striker. During a cinching routine, the catch is moved into its main latching position by a cinching drive. An overload clutch with two clutch elements is provided in the drive train between the cinching drive and the catch. The clutch elements are in engagement with each other for the transmission of cinching forces. The engagement is load dependent in a beginning section of the cinching routine, such that the engagement, and thereby the overload clutch, is disconnected in reaction to exceeding a predefined limit load in the drive train. The engagement is load independent in the remaining, subsequent section of the cinching routine.

16 Claims, 4 Drawing Sheets

(51) Int. Cl.
*E05B 81/18* (2014.01)
*E05B 81/06* (2014.01)

(58) Field of Classification Search
CPC ..... E05B 81/26; E05B 81/28; E05B 81/30; E05B 81/48; E05B 85/26; Y10T 292/1047; Y10T 292/1082; Y10S 292/23; Y10S 292/42; Y10S 292/43
See application file for complete search history.

(56) References Cited

U.S. PATENT DOCUMENTS

| | | | | |
|---|---|---|---|---|
| 6,964,438 | B2 * | 11/2005 | Koike | E05B 81/20 292/201 |
| 7,111,878 | B2 | 9/2006 | Kachouh | |
| 7,261,334 | B2 | 8/2007 | Oberheide et al. | |
| 7,380,844 | B2 | 6/2008 | Berghahn et al. | |
| 8,807,807 | B2 | 8/2014 | Wheeler et al. | |
| 9,874,046 | B2 | 1/2018 | Wittelsbuerger et al. | |
| 10,005,498 | B2 | 6/2018 | Rosales et al. | |
| 2006/0048451 | A1 | 3/2006 | Fukumura et al. | |
| 2009/0151257 | A1 | 6/2009 | Dominique | |
| 2017/0130490 | A1 | 5/2017 | Wirths | |
| 2019/0145135 | A1 | 5/2019 | Lebsak et al. | |
| 2020/0024874 | A1 | 1/2020 | Rosales | |
| 2020/0040618 | A1 * | 2/2020 | Bendel | E05B 81/20 |
| 2021/0017794 | A1 | 1/2021 | Drost et al. | |
| 2021/0230911 | A1 * | 7/2021 | Weichsel | E05B 81/21 |
| 2021/0270065 | A1 * | 9/2021 | Reusch | E05B 81/30 |

FOREIGN PATENT DOCUMENTS

| | | | | |
|---|---|---|---|---|
| DE | 102004011798 | B3 * | 10/2005 | E05B 81/15 |
| DE | 102005004571 | | 8/2006 | |
| DE | 102016107717 | | 10/2017 | |
| EP | 0133508 | | 2/1985 | |
| EP | 1319780 | B1 * | 1/2005 | E05B 81/20 |
| EP | 1617021 | | 8/2007 | |
| WO | 0049252 | | 8/2000 | |
| WO | 2007090389 | W | 8/2007 | |
| WO | WO-2020007409 | A1 * | 1/2020 | E05B 81/62 |

OTHER PUBLICATIONS

"Non-Final Office Action," for U.S. Appl. No. 16/039,851 dated Apr. 29, 2021 (18 pages).
"Response to Non Final Office Action," for U.S. Appl. No. 16/039,851, filed Oct. 29, 2021 (11 pages).
"Non-Final Office Action," for U.S. Appl. No. 16/039,851 dated Apr. 11, 2022 (14 pages).
"Response to Final Rejection," dated Dec. 20, 2021 for U.S. Appl. No. 16/039,851, submitted via EFS-Web on Mar. 21, 2022, 8 pages.

* cited by examiner

MOTOR VEHICLE LOCK

FIELD OF THE TECHNOLOGY

The disclosure is directed to a method for operating a motor vehicle lock, to a motor vehicle lock arrangement and to a motor vehicle door arrangement.

BACKGROUND

The motor vehicle lock in question is assigned to a motor vehicle door arrangement, which comprises at least a motor vehicle door. The expression "motor vehicle door" is to be understood in a broad sense. It includes in particular side doors, back doors, liftgates, trunk lids or engine hoods. Such a motor vehicle door may generally be designed as a sliding door as well.

In order to increase the user-friendliness during closing of the motor vehicle door, today's motor vehicle locks are often equipped with a so-called cinching function. The cinching function provides a motorized movement of the catch of a motor vehicle lock from its preliminary latching position into its main latching position, which goes along with pulling the respective motor vehicle door from a preliminary door position into a main door position. This very last part of the closing movement of the motor vehicle door requires a considerable force against the door seals. This is why the cinching function is to be considered an important comfort feature.

The known motor vehicle lock (EP 1 617 021 B1), which is the starting point for the disclosure, represents a possible realization of the above noted cinching function. According to this it is known that the motor vehicle lock is provided with a cinching element and a cinching drive, such that, during a cinching routine, the catch may be moved into its main latching position by the cinching drive via the cinching element. The cinching routine is initiated by a manual movement of the catch into the preliminary latching position. This manual movement of the catch into its preliminary latching position goes back on the user moving the motor vehicle door manually into the preliminary door position.

While normally the above noted cinching function increases the user-friendliness in a very intuitive way, the cinching function also comprises a certain injury risk. The reason for this is the fact that with the catch in its preliminary latching position, a certain gap between the motor vehicle door and the motor vehicle body remains. In case an object, finger or the like has been inserted into the gap, the full cinching force is applied to such means. This generally decreases the operational safety of the motor vehicle lock in question.

SUMMARY

It is therefore an object of the disclosure to improve the known motor vehicle lock such that the operational safety of the cinching function is increased with low constructional effort.

The above noted object is solved for a method as described herein.

A general idea underlying the disclosure is to provide an overload clutch in the drive train between the cinching drive and the catch, which has the characteristics of an overload clutch only in a first section of the cinching routine. The overload clutch is designed such that in case a predefined limit load in the drive train is exceeded, the overload clutch disconnects. This is an effective safety measure in a collision situation, in which an object like a finger of the user has been inserted into the gap between the motor vehicle door and the motor vehicle body. The controlled disconnection of the overload clutch guarantees that the pinched object, here the finger of the user, does not have to withstand more than the predefined limit load.

In further detail it is proposed that in the drive train between the cinching drive and the catch an overload clutch with two clutch elements is provided, which clutch elements are in engagement with each other for the transmission of cinching forces. This force transmitting engagement is load dependent in a beginning section of the cinching routine, such that the engagement and thereby the overload clutch is disconnected in reaction to exceeding a predefined limit load in the drive train. In the remaining, subsequent section of the cinching routine this force transmitting engagement is load independent. This means that in the subsequent section of the cinching routine the overload clutch acts as a rigid force transmitting element.

In an embodiment, in the mounted state, the catch being moved from the preliminary latching position into the main latching position, corresponds to the gap between the motor vehicle door and the motor vehicle body decreasing from a preliminary gap to no gap. This means that the main latching position of the catch corresponds to the fully closed motor vehicle door. The size of the preliminary gap, which corresponds to the catch being positioned in its preliminary latching position, can be between 4 mm and 8 mm. This may easily be closed by the cinching drive, which, however, also imposes a certain risk of a user inserting a finger into the gap. Accordingly, the proposed solution is of particular advantage for this embodiment.

Various embodiments are directed to the gap being reduced down to at least 3 mm, such as down to at least 2 mm during the beginning section of the cinching routine. This means that during the beginning section of the cinching routine, which provides a high user safety due to the characteristics of the overload clutch, the gap is being reduced to a size which does not impose any risk on the user anymore. With this additional feature, the proposed solution provides an outstanding user safety.

According to some embodiments the predefined limit load corresponds to a relatively low cinching force between the motor vehicle door and the motor vehicle body of less than 50 N and further, in some embodiments, of less than 20 N. This force is particularly low, taking into account that the maximum cinching force between the motor vehicle door and the motor vehicle body is between 250 N and 400 N.

The characteristics of the overload clutch in the beginning section of the cinching routine can be based on a releasable form fit engagement. A mechanically simple design may be achieved by providing the clutch elements with clutch contours, which are spring biased by a spring bias arrangement.

The change in characteristics of the overload clutch may be achieved by a change in the constellation of the clutch contours relative to each other. With this a change in the direction of contact forces between the two clutch elements is easily possible, such that in the subsequent section of the cinching routine a load independent and force transmitting form fit between the clutch contours is being built.

A simple measure to realize the change in constellation of the clutch contours relative to each other is a guide contour for at least one of the clutch elements according to some embodiments. With this it is possible to change the interaction of the clutch elements dependent from the progress of the cinching routine.

A particularly compact arrangement may be achieved, if one of the clutch elements is part of the catch. As the position of the catch represents the progress in the cinching routine, the movement of the catch may well be used for the above noted change in constellation of the clutch contours relative to each other.

Various embodiments provide a motor vehicle lock with a catch and a pawl, which is assigned to the catch, wherein the catch may be moved into an open position, into a preliminary latching position and into a main latching position, wherein the catch, which is in one of the latching positions, is or may be brought into holding engagement with a lock striker, wherein the pawl may be moved into an engagement position, in which it is in blocking engagement with the catch, and wherein the pawl may be moved into a release position, in which it releases the catch, wherein in the installed state, during a cinching routine, the catch is being moved into its main latching position by a cinching drive, wherein in the drive train between the cinching drive and the catch an overload clutch with two clutch elements is provided, which clutch elements are in engagement with each other for the transmission of cinching forces, which engagement is load dependent in a beginning section of the cinching routine, such that the engagement and thereby the overload clutch is disconnected in reaction to exceeding a predefined limit load in the drive train and which engagement is load independent in the remaining, subsequent section of the cinching routine.

In various embodiments, in the mounted state, with the catch being moved from the preliminary latching position into the main latching position during the cinching routine, the gap between the motor vehicle door and the motor vehicle body decreases from a preliminary gap to no gap.

In various embodiments, the size of the preliminary gap is between 4 mm and 8 mm, such as 6 mm.

In various embodiments, during the beginning section of the cinching routine the gap reduces down to at least 3 mm, such as down to at least 2 mm.

In various embodiments, in the installed state, the predefined limit load corresponds to a pinching force between the motor vehicle door and the motor vehicle body of less than 50 N, such as less than 20 N.

In various embodiments, in the beginning section of the cinching routine, the engagement between the two clutch elements is a releasable form fit engagement, wherein for the release an elastic deformation element deforms in reaction to exceeding the limit load in the drive train.

In various embodiments, the clutch elements each comprise a clutch contour and that the clutch elements are in engagement with each other via their respective clutch contours.

In various embodiments, a spring bias arrangement is provided that spring biases the clutch contours against each other and that the clutch contours and the spring bias are synchronized to each other such that in the beginning section of the cinching routine the clutch contours come out of force transmitting engagement from each other in reaction to exceeding the limit load in the drive train.

In various embodiments, the elastic deformation element is provided by the spring bias arrangement.

In various embodiments, proceeding from the beginning section of the cinching routine to the subsequent section of the cinching routine the constellation of the clutch contours relative to each other changes such that the clutch contours build a form fit, which is load independent.

In various embodiments, a guide contour for at least one of the clutch elements is provided, which guides the clutch element or the clutch elements into the change in constellation when proceeding from the beginning section of the cinching routine to the subsequent section of the cinching routine.

In various embodiments, one of the clutch elements is a part of the catch, such as an engagement section of the catch, such as a nose which is arranged on the catch, in particular on the circumference of the catch.

Various embodiments provide a motor vehicle lock arrangement with a motor vehicle lock as described herein and a cinching drive connected to the motor vehicle lock.

Various embodiments provide a motor vehicle door arrangement with a motor vehicle door and a motor vehicle lock arrangement as described herein.

BRIEF DESCRIPTION OF THE DRAWINGS

In the following various embodiments will be described in an example referring to the drawings. In the drawings.

DETAILED DESCRIPTION

Figure 1:
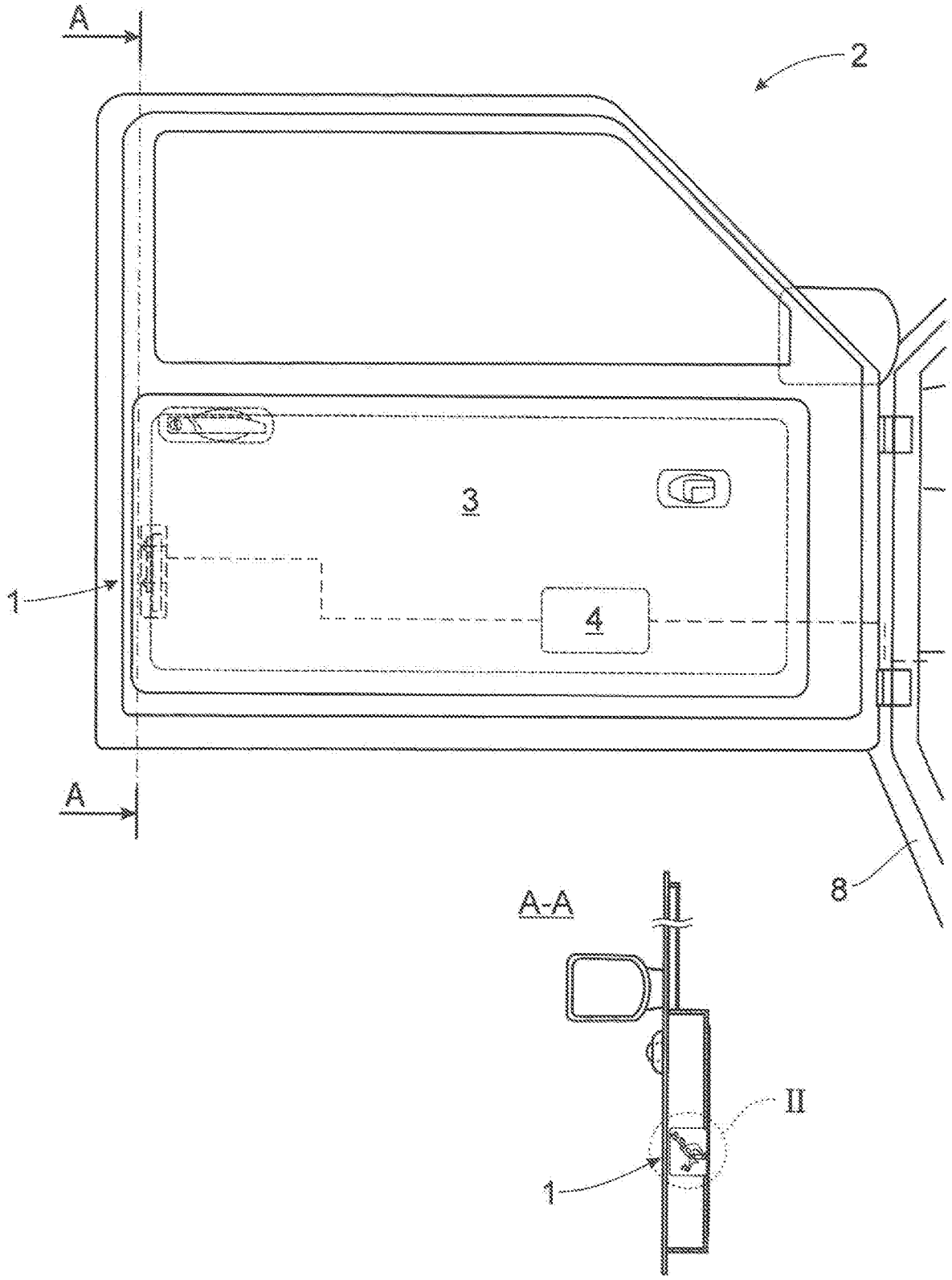
FIG. 1 depicts a proposed motor vehicle door arrangement with a proposed motor vehicle lock arrangement including a proposed motor vehicle lock.

The motor vehicle lock 1 shown in the drawings is assigned to a motor vehicle door arrangement 2, which comprises a motor vehicle door 3 besides the motor vehicle lock 1. The motor vehicle lock 1 is designed for being operated by a lock control 4.

Regarding the broad interpretation of the expression "motor vehicle door" reference is made to the introductory part of this specification. Here, the motor vehicle door 3 is a side door of a motor vehicle.

The motor vehicle lock 1 comprises the usual locking elements catch 5 and pawl 6, which pawl 6 is assigned to the catch 5. The catch 5 may be moved into an open position, into a preliminary latching position (FIG. 2) and into a main latching position (FIG. 3*b*). The catch 5, which is in one of the latching positions, is or may be brought into holding engagement with a lock striker 7, as is shown in FIG. 3*b* for the example of the main latching position of the catch 5.

Here, the motor vehicle lock 1 is arranged on the motor vehicle door 3, while the lock striker 7 is arranged on the motor vehicle body 8. This may be realized the other way around as well.

Figure 2:
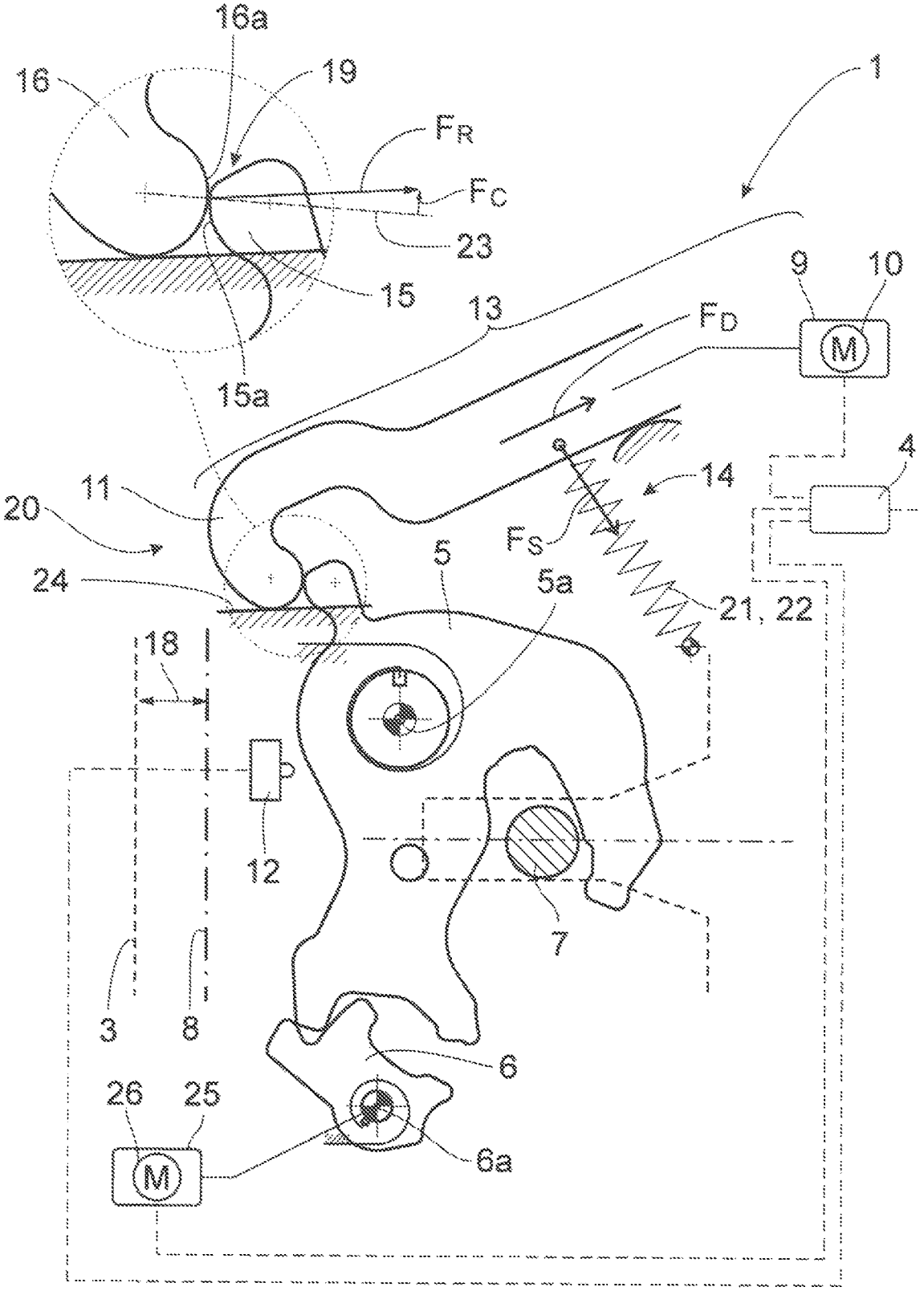
FIG. 2 depicts the motor vehicle lock of FIG. 1 with the catch in its preliminary latching position.

The pawl 6 may be moved into an engagement position, which is shown in FIG. 2 for the preliminary latching position and in FIG. 3*b* for the main latching position. In the engagement position, the pawl 6 is in blocking engagement with the catch 5, preventing the catch 5 from moving into its opening direction. In addition, the pawl 6 may be moved into a release position, in which it releases the catch 5, freeing the catch 5 to a movement into its opening direction. The wording "blocking engagement" is to be understood in a broad sense. It means that the pawl 6 is able to hold the catch 5 in its respective latching position. This can also include that the pawl 6 itself has to be engaged by another pawl in order to hold the catch 5 in its respective latching position.

Here the catch 5 is pivotable around the catch axis 5*a*, while the pawl 6 is pivotable around the pawl axis 6*a*. Generally there are other possibilities for realizing the movement of the catch 5 and/or the pawl 6.

For realizing the above noted cinching function, a cinching drive 9 is provided. The cinching drive 9 may be integrated into the motor vehicle lock 1. As an alternative, the cinching drive 9 may be realized separately from the motor vehicle lock 1. In this alternative, the cinching drive 9 may be drivingly coupled to the motor vehicle lock 1, in particular to the catch 5, via a Bowden cable arrangement or the like.

In any case, the catch 5 has to be drivingly coupled to the cinching drive 9, such that the catch 5 may be driven by the cinching drive 9 during a cinching routine.

Here the cinching drive 9 is designed as a motorized drive. Accordingly, the cinching drive 9 can include a cinching motor 10, which can be realized as an electric motor. The electric motor can further comprise a rotational output shaft, which is drivingly coupled to a cinching element 11, which transmits the force generated by the cinching drive 9 to the catch 5.

During the cinching routine, the catch 5 is being moved into its main latching position by the cinching drive 9 via the cinching element 11. For this, the cinching element 11 engages the catch 5, as may be taken from the transition of FIG. 3*a* to FIG. 3*b*. In some embodiments, the cinching routine includes moving the catch 5 from its preliminary latching position into its main latching position by the cinching drive 9.

In some embodiments, the cinching routine is initiated in a very intuitive way. In detail, a manual movement of the catch 5 from the open position into the preliminary latching position causes the cinching routine to be initiated by the lock control 4. The expression "manual movement" means, that the movement of the catch 5 in so far has been caused without the support of the cinching drive 9. This manual movement of the catch 5 accordingly goes back on a closing movement of the motor vehicle door 3 from an open door position, which corresponds to the open position of the catch 5, into a preliminary door position, which corresponds to the preliminary latching position of the catch 5.

The lock control 4 monitors, if a manual movement of the catch 5 from the open position into the preliminary latching position has taken a place and accordingly causes the cinching routine to be initiated. For this, the lock control 4 can be control-wise coupled to a catch sensor 12, which may be a simple micro switch or the like. Other possibilities for monitoring the catch movement are well applicable.

In some embodiments in the drive train 13 between the cinching drive 9 and the catch 5 an overload clutch 14 with two clutch elements 15, 16 is provided, which clutch elements 15, 16 are in engagement with each other for the transmission of cinching forces. The cinching forces are those forces that are causal for moving the catch 5 during the cinching routine.

The above noted force transmitting engagement between the cinching elements 15, 16 is load dependent in a beginning section of the cinching routine, such that the engagement and thereby the overload clutch 14 is disconnected in reaction to exceeding a predefined limit load in the drive train 13. This ensures that a pinched jacked like a finger of the user does not experience excessive pinching forces, before the overload clutch is disconnected.

However, in order to guarantee, that the cinching routine is not jeopardized by this safety measure, the force transmitting engagement between the clutch elements 15, 16 is load independent in the remaining, subsequent section of the cinching routine. The beginning section of the cinching routine corresponds to an area of movement of the catch 5 between the preliminary latching position (FIG. 2) to a catch position shown in FIG. 3*a*, which is between the preliminary latching position and the main latching position. Further proceeding in the cinching routine, a transition from the beginning section of the cinching routine to the subsequent section of the cinching routine takes place. The end of the subsequent section of the cinching routine is shown in FIG. 3*b*.

It is to be noted that, depending on the mechanical realization, the transition from the beginning section of the cinching routine to the subsequent section of the cinching routine may vary. Solely important is the fact that such transition takes place in the course of the cinching routine.

Figure 3:
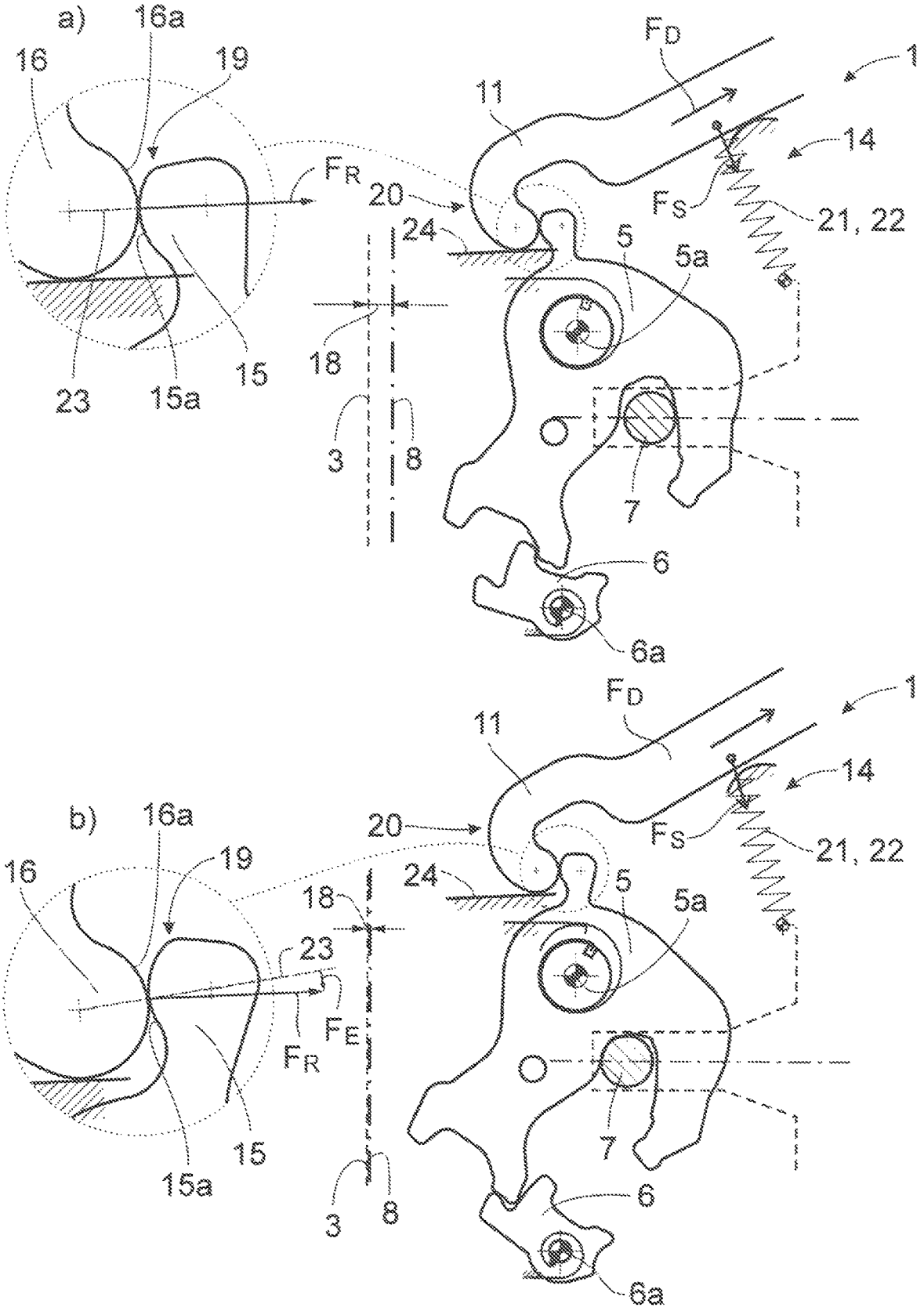
FIG. 3 depicts the motor vehicle lock according to FIG. 1 during the cinching routine in normal operation a) with the catch between its preliminary latching position and its main latching position and b) with the catch in an overtravel position beyond the main latching position.

While FIG. 3 shows the beginning section of the cinching routine (FIG. 3*a*) and the subsequent section of the cinching routine (FIG. 3*b*) for a normal operation, FIG. 4*a* shows the beginning section of the cinching routine in a collision situation, in which a finger 17 of a user has been inserted into the gap 18 between the motor vehicle door 3 and the motor vehicle body 8. Further proceeding the cinching routine starting from FIG. 4*a* it becomes clear from FIG. 4*b*, that the overload clutch 14 has been disconnected in reaction to exceeding the predefined limit load. A further cinching movement of the catch 5 is not possible in this situation, which allows the user to retract his finger 17 from the gap 18.

Generally, in the mounted state, with the catch 5 being moved from the preliminary latching position into the main latching position during the cinching routine, the gap 18 between the motor vehicle door 3 and the motor vehicle body 8 decreases from a preliminary gap (FIG. 2) to no gap (FIG. 3*b*).

The size of the preliminary gap 18, which corresponds to the preliminary latching position of the catch 5, can be between 4 mm and 8 mm, such as 6 mm. This shows that generally the insertion of a finger 17 of the user imposes a risk of injury.

In the installed state, the predefined limit load corresponds to a pinching force between the motor vehicle door 3 and the motor vehicle body 8 of less than 50 N, such as less than 20 N. This means that during the beginning section of the cinching routine the risk of injury for the user is considerably reduced. The limit load may easily be adjusted to a desired value just by a corresponding design of the overload clutch 14.

Figure 4:
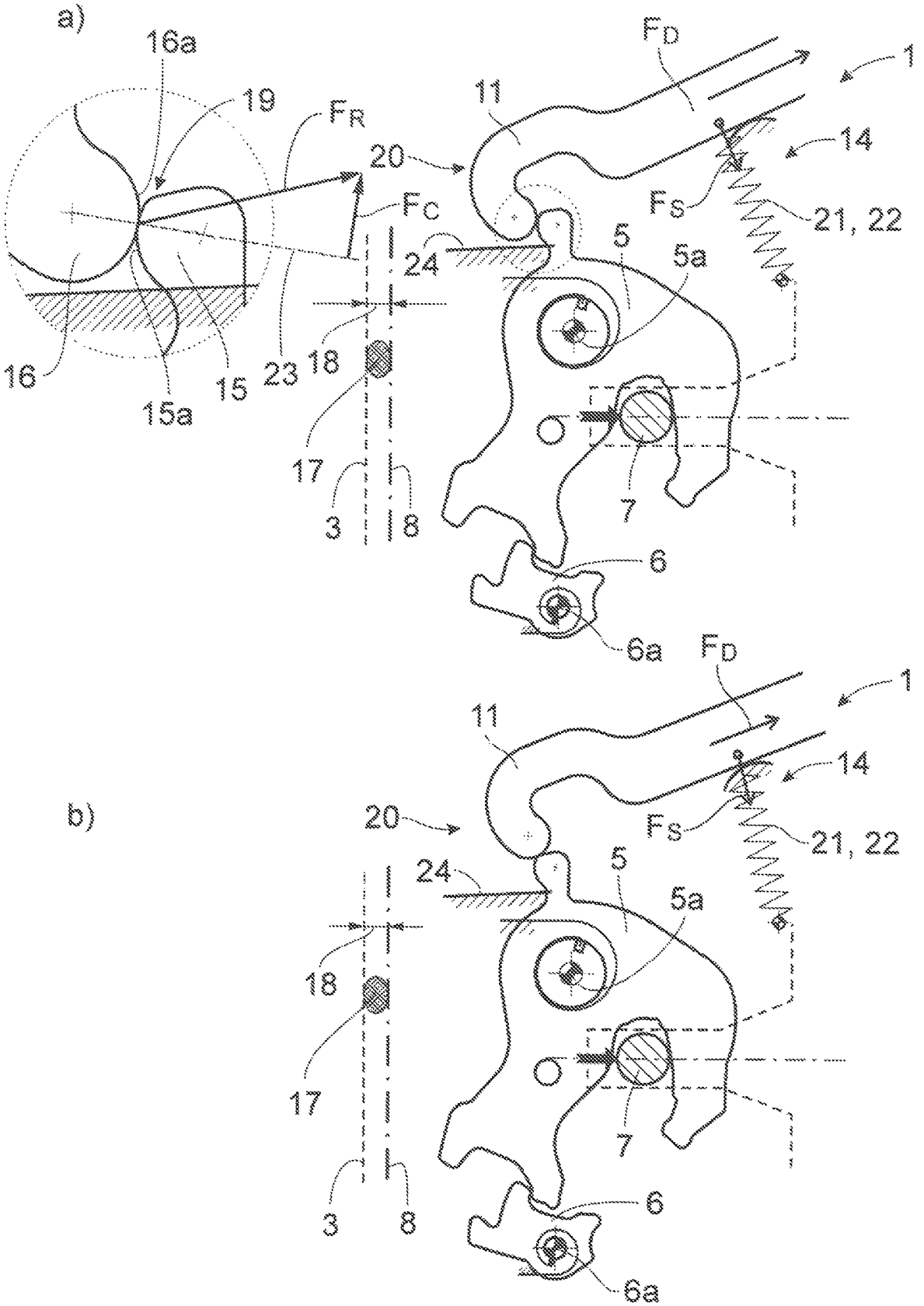
FIG. 4 depicts the motor vehicle lock according to FIG. 1 during the cinching routine in a collision situation a) with the catch between its preliminary latching position and its main latching position and b) with the overload clutch being disconnected.

A comparison of FIG. 3*a* with FIG. 4 shows that in the beginning section of the cinching routine, the engagement between the two clutch elements 15, 16 is a releasable form fit engagement. FIG. 3*a* shows that the catch 5 at its outer circumference comprises a nose 19, which provides the clutch element 15, while a hook-like element 20, which may be driven by the cinching drive 9, provides the clutch element 16. The two clutch elements 15, 16 are being held in the form fit engagement shown in FIG. 3*a* by an elastic deformation element 21. Without this elastic deformation element 21 the arrangement is such that any drive movement from the cinching drive 9 would release the form fit between the clutch elements 15, 16.

This means that exceeding the limit load in the drive train causes the elastic deformation element 21 to deform which leads to the release of the form fit between the clutch elements 15, 16. This is a simple general concept to provide a releasable, load dependent form fit between two clutch elements 15, 16.

The clutch elements 15, 16 each can comprise a clutch contour 15*a*, 16*a*, wherein the clutch elements 15, 16 are in engagement with each other via their respective clutch contours 15*a*, 16*a*, as may be seen from FIGS. 2 to 4.

Here, the elastic deformation element is provided by a spring bias arrangement 22, as indicated in FIGS. 2 to 4 as well. The spring bias arrangement 22 biases the clutch contours 15*a*, 16*a* of the clutch elements 15, 16 against each other, as shown in FIG. 3. It is of particular importance that the clutch contours 15*a*, 16*a* and the spring bias are synchronized to each other such that in the beginning section of the cinching routine the clutch contours 15*a*, 16*a* come out of force transmitting engagement from each other in reaction to exceeding the limit load in the drive train 13. This becomes clear from a comparison of FIG. 3*a* and FIG. 4*a*. In FIG. 3*a* the resulting force $F_R$ of the driving force $F_D$ and the spring bias force $F_S$ is identical to the normal vector 23 at the point of contact between the two clutch contours 15*a*, 16*a*. This means that no component of force is urging the clutch element 16 out of engagement from the clutch element 15.

However, looking at FIG. 4*a*, an increase of driving force $F_D$ takes place, which goes back on increase on the reaction force of the catch 5, which again goes back on the finger 17 of the user being inserted in the gap 18 and withstanding the gap 18 to be closed any further. The increasing driving force $F_D$ leads to a change in direction of the resulting force $F_R$, which now comprises a force component $F_C$, which urges the clutch element 16 out of engagement from the clutch element 15. As soon as the frictional force between the clutch elements 15, 16 is overcome, the clutch element 16 disengages the clutch element 15, as shown in FIG. 4*b*.

In normal operation, however, this engagement does not take place. Proceeding from the beginning section of the cinching routine to the subsequent section of the cinching routine than changes the constellation of the clutch contours 15*a*, 16*a* relative to each other such that the clutch contours 15*a*, 16*a* build a form fit, which is load independent. This is shown in FIG. 3*b* for the end of the subsequent section of the cinching routine. Here the resulting force $F_R$ even comprises a force component $F_E$, which urges the clutch element 16 to further engage the clutch element 15, which may be taken from FIG. 3*b* as well.

This change of constellation has been achieved simply by a slide variation of the contours 15*a*, 16*a* relative to each other. For this, a guide contour 24 for the clutch element 16 can be provided, which guides the clutch element 16 into the change in constellation when proceeding from the beginning section of the cinching routine to the subsequent section of the cinching routine. As may be taken from the sequence of FIGS. 3*a* and 3*b*. Alternatively or in addition, such a guide contour 24 may be provided for the clutch element 15 as well.

As noted above, one of the clutch elements 15 is a part of the catch 5. The engagement section of the catch 5 can be a nose 19, which is arranged on the catch 5, in particular on the circumference of the catch 5, as noted above.

The engagement section of the catch is necessary for any kind of cinching routine, in order to transmit cinching forces into the catch 5. The integration of the proposed overload clutch 14 into this engagement area of the catch 5 lead to a particularly compact overall design.

According to another teaching the motor vehicle lock arrangement comprising the motor vehicle lock 1 and the cinching drive 9 connected to the motor vehicle lock 1. Accordingly, all details given for the proposed method are fully applicable to this second teaching.

According to another teaching, which is of equal importance, the motor vehicle door arrangement 2 with a motor vehicle door 3 and the above noted motor vehicle lock arrangement is disclosed. Again, all details regarding the proposed method and regarding the proposed motor vehicle lock arrangement are fully applicable.

Just as a matter of completeness it may be pointed out, that in the opening direction of the catch 5, the positions of the catch 5 are arranged in the order of main latching position, preliminary latching position and open position.

Finally it may be pointed out that generally the pawl 6 may be moved into its release position by manual actuation forces by the user. Here, however, an opening drive 25 is provided, which comprises an opening motor 26 for motorized moving of the pawl 6 into its release position. The opening drive 25 is being controlled by the lock control 4 just as the cinching drive 9 noted above.

The invention claimed is:

1. A motor vehicle lock comprising:

a catch and a pawl, which is assigned to the catch, wherein the catch may be moved into an open position, into a preliminary latching position and into a main latching position, wherein the catch, which is in one of the latching positions, is or may be brought into holding engagement with a lock striker, wherein the pawl may be moved into an engagement position, in which it is in blocking engagement with the catch, and wherein the pawl may be moved into a release position, in which it releases the catch, wherein in an installed state, during a cinching routine, the catch is being moved into the main latching position by a cinching drive, wherein an overload clutch with two clutch elements is provided in the drive train between the cinching drive and the catch, wherein the clutch elements are in engagement with each other for the transmission of cinching forces, which engagement is load dependent in a beginning section of the cinching routine, such that the engagement and thereby the overload clutch is disconnected in reaction to exceeding a predefined limit load in the drive train, and which engagement is load independent in the remaining, subsequent section of the cinching routine, wherein in the beginning section of the cinching routine, the engagement between the two clutch elements is a releasable form fit engagement, wherein for the release an elastic deformation element deforms in reaction to exceeding the limit load in the drive train, wherein the clutch elements each comprise a clutch contour and wherein the clutch elements are in engagement with each other via their respective clutch contours, wherein proceeding from the beginning section of the cinching routine to the subsequent section of the cinching routine a constellation of the clutch contours relative to each other changes such that the clutch contours build a form fit, which is load independent.

2. The motor vehicle lock according to claim 1, wherein, in the installed state, with the catch being moved from the preliminary latching position into the main latching position during the cinching routine, a gap between a motor vehicle door and a motor vehicle body decreases from a preliminary gap to no gap.

3. The motor vehicle lock according to claim 2, wherein the size of the preliminary gap is between 4 mm and 8 mm.

4. The motor vehicle lock according to claim 2, wherein during the beginning section of the cinching routine the gap reduces down to at least 3 mm.

5. The motor vehicle lock according to claim 1, wherein in the installed state, the predefined limit load corresponds to a pinching force between a motor vehicle door and a motor vehicle body of less than 50 N.

6. The motor vehicle lock according to claim 1, further comprising a spring bias arrangement that spring biases the clutch contours against each other and wherein the clutch contours and the spring bias are synchronized to each other such that in the beginning section of the cinching routine the clutch contours come out of force transmitting engagement from each other in reaction to exceeding the limit load in the drive train.

7. The motor vehicle lock according to claim 6, wherein the elastic deformation element is provided by the spring bias arrangement.

8. The motor vehicle lock according to claim 1, further comprising a guide contour for at least one of the clutch elements, which guides the clutch element or the clutch elements into a change in constellation when proceeding from the beginning section of the cinching routine to the subsequent section of the cinching routine.

9. The motor vehicle lock according to claim 1, wherein one of the clutch elements is a part of the catch.

10. A motor vehicle lock arrangement with a motor vehicle lock according to claim 1 and a cinching drive connected to the motor vehicle lock.

11. A motor vehicle door arrangement with a motor vehicle door and a motor vehicle lock arrangement according to claim 10.

12. The motor vehicle lock according to claim 2, wherein the size of the preliminary gap is 6 mm.

13. The motor vehicle lock according to claim 2, wherein during the beginning section of the cinching routine the gap reduces down to at least 2 mm.

14. The motor vehicle lock according to claim 1, wherein in the installed state, the predefined limit load corresponds to a pinching force between a motor vehicle door and a motor vehicle body of less than 20 N.

15. The motor vehicle lock according to claim 9, wherein one of the clutch elements is a part of an engagement section of the catch.

16. The motor vehicle lock according to claim 15, wherein the engagement section of the catch includes a nose which is arranged on a circumference of the catch.

* * * * *